US012173588B2

(12) United States Patent
Rajaram et al.

(10) Patent No.: US 12,173,588 B2
(45) Date of Patent: Dec. 24, 2024

(54) ORIENTATION DETECTING SWITCH AND PERFORATING GUN

(71) Applicant: Hunting Titan, Inc., Pampa, TX (US)

(72) Inventors: Sridhar Rajaram, Houston, TX (US); Adam Dyess, Houston, TX (US); Jason Hoang Mai, Houston, TX (US)

(73) Assignee: Hunting Titan, Inc., Pampa, TX (US)

( * ) Notice: Subject to any disclaimer, the term of this patent is extended or adjusted under 35 U.S.C. 154(b) by 0 days.

(21) Appl. No.: 18/312,374

(22) Filed: May 4, 2023

(65) Prior Publication Data

US 2023/0304384 A1 Sep. 28, 2023

Related U.S. Application Data

(63) Continuation of application No. PCT/US2022/012563, filed on Jan. 14, 2022.

(60) Provisional application No. 63/137,575, filed on Jan. 14, 2021.

(51) Int. Cl.

| | |
|---|---|
| ***E21B 43/119*** | (2006.01) |
| ***E21B 43/117*** | (2006.01) |
| ***F42D 5/00*** | (2006.01) |

(52) U.S. Cl.

CPC ..... *E21B 43/119* (2013.01); *E21B 43/117* (2013.01); *F42D 5/00* (2013.01)

(58) Field of Classification Search

None

See application file for complete search history.

(56) References Cited

U.S. PATENT DOCUMENTS

| | | | | |
|---|---|---|---|---|
| 10,352,144 | B2 | 7/2019 | Entchev et al. | |
| 11,268,376 | B1 * | 3/2022 | Jackson | E21B 43/116 |
| 11,619,119 | B1 * | 4/2023 | Roper | E21B 47/024 166/297 |
| 2015/0096752 | A1 | 4/2015 | Burgos et al. | |
| 2015/0275643 | A1 | 10/2015 | Holder et al. | |
| 2019/0153829 | A1 | 5/2019 | Roessler | |
| 2019/0284889 | A1 | 9/2019 | LaGrange et al. | |
| 2019/0353013 | A1 | 11/2019 | Sokolove et al. | |
| 2020/0256168 | A1 | 8/2020 | Knight et al. | |
| 2020/0386085 | A1 | 12/2020 | Badii et al. | |
| 2021/0348485 | A1 | 11/2021 | Mauldin et al. | |

OTHER PUBLICATIONS

Written Opinion of the International Searching Authority, PCT/US2022/012563, dated Apr. 18, 2022, 7 pages.

* cited by examiner

*Primary Examiner* — Reginald S Tillman, Jr.

(57) ABSTRACT

A method and apparatus for detecting the orientation of each perforating gun in a wellbore and using that information in arming and firing each perforating gun in a perforating gun string.

24 Claims, 3 Drawing Sheets

ORIENTATION DETECTING SWITCH AND PERFORATING GUN

RELATED APPLICATIONS

This application claims priority to PCT/US2022/012563, filed on Jan. 14, 2022, which claims the benefit of U.S. Provisional Application No. 63/137,575, filed Jan. 14, 2021.

BACKGROUND

Generally, when completing a subterranean well for the production of fluids, minerals, or gases from underground reservoirs, several types of tubulars are placed downhole as part of the drilling, exploration, and completions process. These tubulars can include casing, tubing, pipes, liners, and devices conveyed downhole by tubulars of various types. Each well is unique, so combinations of different tubulars may be lowered into a well for a multitude of purposes.

A subsurface or subterranean well transits one or more formations. The formation is a body of rock or strata that contains one or more compositions. The formation is treated as a continuous body. Within the formation hydrocarbon deposits may exist. Typically a wellbore will be drilled from a surface location, placing a hole into a formation of interest. Completion equipment will be put into place, including casing, tubing, and other downhole equipment as needed. Perforating the casing and the formation with a perforating gun is a well-known method in the art for accessing hydrocarbon deposits within a formation from a wellbore.

Explosively perforating the formation using a shaped charge is a widely known method for completing an oil well. A shaped charge is a term of art for a device that when detonated generates a focused output, high energy output, and/or high velocity jet. This is achieved in part by the geometry of the explosive in conjunction with an adjacent liner. Generally, a shaped charge includes a metal case that contains an explosive material with a concave shape, which has a thin metal liner on the inner surface. Many materials are used for the liner; some of the more common metals include brass, copper, tungsten, and lead. When the explosive detonates, the liner metal is compressed into a superheated, super pressurized jet that can penetrate metal, concrete, and rock. Perforating charges are typically used in groups. These groups of perforating charges are typically held together in an assembly called a perforating gun. Perforating guns come in many styles, such as strip guns, capsule guns, port plug guns, and expendable hollow carrier guns.

Perforating charges are typically detonated by a detonating cord in proximity to a priming hole at the apex of each charge case. Typically, the detonating cord terminates proximate to the ends of the perforating gun. In this arrangement, an initiator at one end of the perforating gun can detonate all of the perforating charges in the gun and continue a ballistic transfer to the opposite end of the gun. In this fashion, numerous perforating guns can be connected end to end with a single initiator detonating all of them.

The detonating cord is typically detonated by an initiator triggered by a firing head. The firing head can be actuated in many ways, including but not limited to electronically, hydraulically, and mechanically.

Expendable hollow carrier perforating guns are typically manufactured from standard sizes of steel pipe with a box end having internal/female threads at each end. Pin ended adapters, or subs, having male/external threads are threaded one or both ends of the gun. These subs can connect perforating guns together, connect perforating guns to other tools such as setting tools and collar locators, and connect firing heads to perforating guns. Subs often house electronic, mechanical, or ballistic components used to activate or otherwise control perforating guns and other components.

Perforating guns typically have a cylindrical gun body and a charge tube, or loading tube that holds the perforating charges. The gun body typically is composed of metal and is cylindrical in shape. Charge tubes can be formed as tubes, strips, or chains. The charge tubes will contain cutouts called charge holes to house the shaped charges.

It is generally preferable to reduce the total length of any tools to be introduced into a wellbore. Among other potential benefits, reduced tool length reduces the length of the lubricator necessary to introduce the tools into a wellbore under pressure. Additionally, reduced tool length is also desirable to accommodate turns in a highly deviated or horizontal well. It is also generally preferable to reduce the tool assembly that must be performed at the well site because the well site is often a harsh environment with numerous distractions and demands on the workers on site.

Electric initiators are commonly used in the oil and gas industry for initiating different energetic devices down hole. Most commonly, 50-ohm resistor initiators are used. Other initiators and electronic switch configurations are common.

Modular or "plug and play" perforating gun systems have become increasingly popular in recent years due to the ease of assembly, efficiencies gained, and reduced human error. Most of the existing plug and play systems either (1) utilize a wired in switch and/or detonator, or (2) require an initiating "cartridge" that houses the detonator, switch, electrical contacts and possibly a pressure bulkhead. The wired in switch/detonator option is less desirable, because the gun assembler must make wire connections which is prone to human error. The initiating cartridge option is less desirable because the cartridge can be a large explosive device—in comparison to a standard detonator—thus takes up additional magazine space at the user facility.

Conventional perforating in vertical wells or unconventional perforating in horizontal wells conveyed by electrical line during which one or more of the perforating guns in the downhole tool string are oriented by either one or more of the following orientating methods: motorized orientation tool, eccentric weight bars and self-orienting charge tube assemblies.

Oriented perforating is a completion method used to connect to the reservoir formation in a specific transverse plane or to avoid perforating other wellbore tubulars and data lines, such as fiber optic cable, attached to the inside or outside of the casing which is being perforated.

SUMMARY OF EXAMPLE EMBODIMENTS

An example embodiment may include a perforating gun system comprising a perforating gun string having at least one perforating gun, the perforating gun further comprising: a housing, a charge tube, a plurality of shaped charges, a detonator cord having a distal end and further coupled to the plurality of shaped charges, a detonator located side-by-side with the distal end of the detonator cord, an electronic switch having an onboard accelerometer, wherein the switch selectively addresses and initiate a downhole ballistic device.

A variation of the example embodiment may include the switch providing orientation data for each of the at least one perforating guns. The onboard accelerometer may be a 3-axis accelerometer. The onboard accelerometer may be a 2-axis accelerometer. The onboard accelerometer may be a single-axis accelerometer. The switch may independently provide orientation data for each perforating gun in a gun string. The switch may signal to the surface that the perforating gun casing is in the horizontal section of a wellbore. It may include a mechanical orienting tool above the gun string with the ability to rotate the at least one downhole gun. The electronic switch may engage a safety to prevent firing the detonator when an undesirable orientation is detected by the accelerometer. The electronic switch may disengage a safety to allow the firing of the detonator when a desirable orientation is detected by the accelerometer. The shaped charges may be in a single plane.

An example embodiment may include a method for perforating a well comprising lowering a perforating gun into a vertical portion of a wellbore, detecting the orientation of the vertical portion of the wellbore, lowering the perforating gun into a horizontal portion of wellbore, detecting the orientation of the horizontal portion of the wellbore, firing the perforating gun at a desired location and desired orientation in a wellbore.

A variation of the example embodiment may include activating a safety in the perforating gun when a vertical orientation is detected. It may include disarming a safety in the perforating gun when a horizontal orientation is detected. It may include adjusting the orientation of the perforating gun to achieve a desired orientation. The firing of the perforating gun may be in a single plane. It may include disabling the firing circuity of the perforating gun at a surface location based on detecting the orientation of the perforation gun.

An example embodiment may include a method for perforating a well comprising lowering a perforating gun string of a plurality of perforating guns into a vertical portion of a wellbore, detecting the orientation of each of the plurality of perforating guns, lowering the plurality of perforating guns into a horizontal portion of the wellbore, detecting the orientation of each of the plurality of perforating guns in the horizontal portion of the wellbore, firing each perforating gun at a plurality of desired locations and a plurality of desired orientations in a wellbore. A variation may also include activating a safety in the plurality of perforating guns when a vertical orientation is detected. It may include disarming a safety in the plurality of perforating guns when a horizontal orientation is detected. It may include adjusting the orientation of the plurality of perforating guns to achieve a desired orientation for at least one perforating gun. The firing of each of the plurality of perforating guns may be in a single plane. It may include disabling the firing circuity of each of the plurality of perforating guns at a surface location.

BRIEF DESCRIPTION OF THE DRAWINGS

For a thorough understanding of the example embodiments, reference is made to the following detailed description of the preferred embodiments, taken in conjunction with the accompanying drawings in which reference numbers designate like or similar elements throughout the several figures of the drawing. Briefly.

DETAILED DESCRIPTION OF THE EXAMPLE EMBODIMENTS

In the following description, certain terms have been used for brevity, clarity, and examples. No unnecessary limitations are to be implied therefrom and such terms are used for descriptive purposes only and are intended to be broadly construed. The different apparatus, systems and method steps described herein may be used alone or in combination with other apparatus, systems and method steps. It is to be expected that various equivalents, alternatives, and modifications are possible within the scope of the appended claims.

Terms such as booster may include a small metal tube containing secondary high explosives that are crimped onto the end of detonating cord. The explosive component is designed to provide reliable detonation transfer between perforating guns or other explosive devices, and often serves as an auxiliary explosive charge to ensure detonation.

Detonating cord is a cord containing high-explosive material sheathed in a flexible outer case, which is used to connect the detonator to the main high explosive, such as a shaped charge. This provides an extremely rapid initiation sequence that can be used to fire several shaped charges simultaneously.

A detonator or initiation device may include a device containing primary high-explosive material that is used to initiate an explosive sequence, including one or more shaped charges. Two common types may include electrical detonators and percussion detonators. Detonators may be referred to as initiators. Electrical detonators have a fuse material that burns when high voltage is applied to initiate the primary high explosive. Percussion detonators contain abrasive grit and primary high explosive in a sealed container that is activated by a firing pin. The impact of the firing pin is sufficient to initiate the ballistic sequence that is then transmitted to the detonating cord.

Initiators may be used to initiate a perforating gun, a cutter, a setting tool, or other downhole energetic device. For example, a cutter is used to cut tubulars with focused energy. A setting tool uses a pyrotechnic to develop gases to perform work in downhole tools. Any downhole device that uses an initiator may be adapted to use the modular initiator assembly disclosed herein.

Figure 1A:
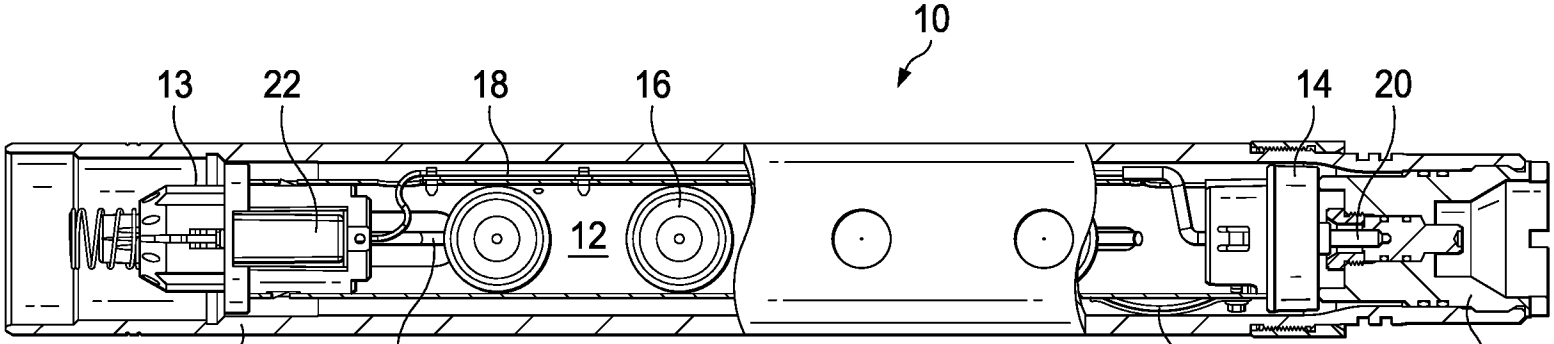
FIG. 1A shows an example embodiment of a perforating gun with orientation detection.
Figure 1B:
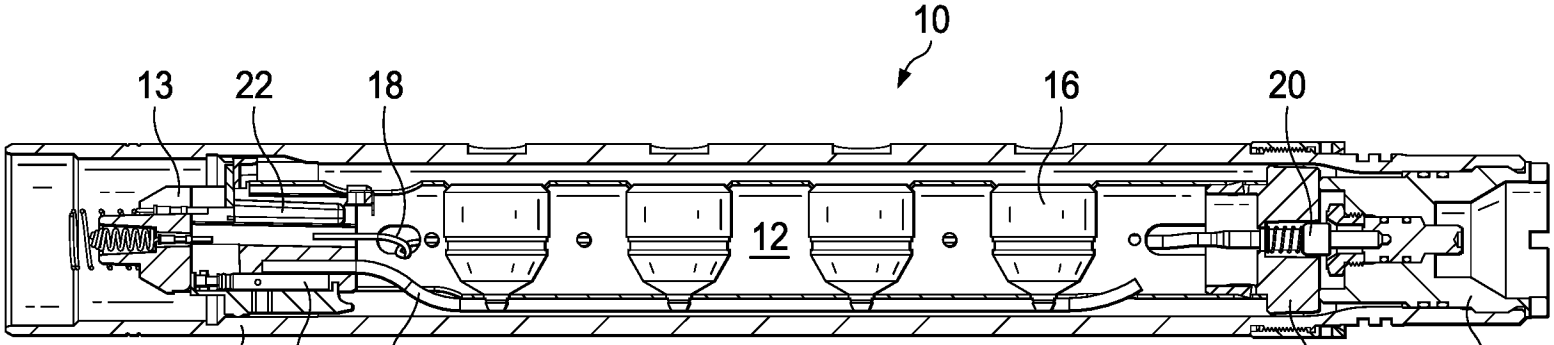
FIG. 1B shows an example embodiment of a perforating gun with orientation detection.

An example embodiment as shown in FIGS. 1A and 1B, may include a selective electronic switch 22 which can be embedded in the charge tube assembly 12 of a perforating gun 10, and has the ability to detect the orientation of the shaped charges 16 within the perforating gun 10 and send that information to surface prior to the user initiating the perforating gun 10. The electronic switch 22 includes orientation detection capabilities embedded in each select fire gun in a multiple perforating gun tool string.

The perforating tool string composed of multiple perforating guns 10 utilizes electronic select fire switches in each perforating gun 10 in order to communicate and initiate each perforating gun 10 when desired. Each electronic switch 22 is electrically connected to one detonator 23 which is ballistically connected to the detonating cord 17 which can initiate the shaped charges 16 in a perforating gun 10. The perforating gun 10 includes a gun body 11 containing a charge tube 12. Charge tube 12 is grounded to the gun body 11 via ground spring 21 and screw. The charge tube 12 is held in place on one end by the top end fitting 13. The charge tube 12 is further secured on the bottom end by feed thru puck 14. Baffle 15 facilitates the connection between the feed thru pin 20 and the next gun. Thru wire 18 is connects the feed thru pin 20 to the switch 22 located within the top end fitting 13. The switch 22 is connected to a detonator 23. A detonating cord 17 has one end with a booster crimped on it disposed within the top end fitting 13 and adjacent to the detonator 23. The detonating cord 17 is connected to the distal end of each of the in-phased shaped charges 16.

The switch 22 may activate a safety in each perforating gun 10 when a vertical orientation is detected. The switch 22 may disarm a safety in each perforating gun 10 when a horizontal orientation is detected. The switch 22 may include adjusting the orientation of each perforating gun to achieve a desired orientation. The firing of each of the plurality of perforating guns 10 may be in a single plane. The switch 22 may disable the firing circuity of the perforating gun 10 at a surface location based on the orientation data.

Figure 2:
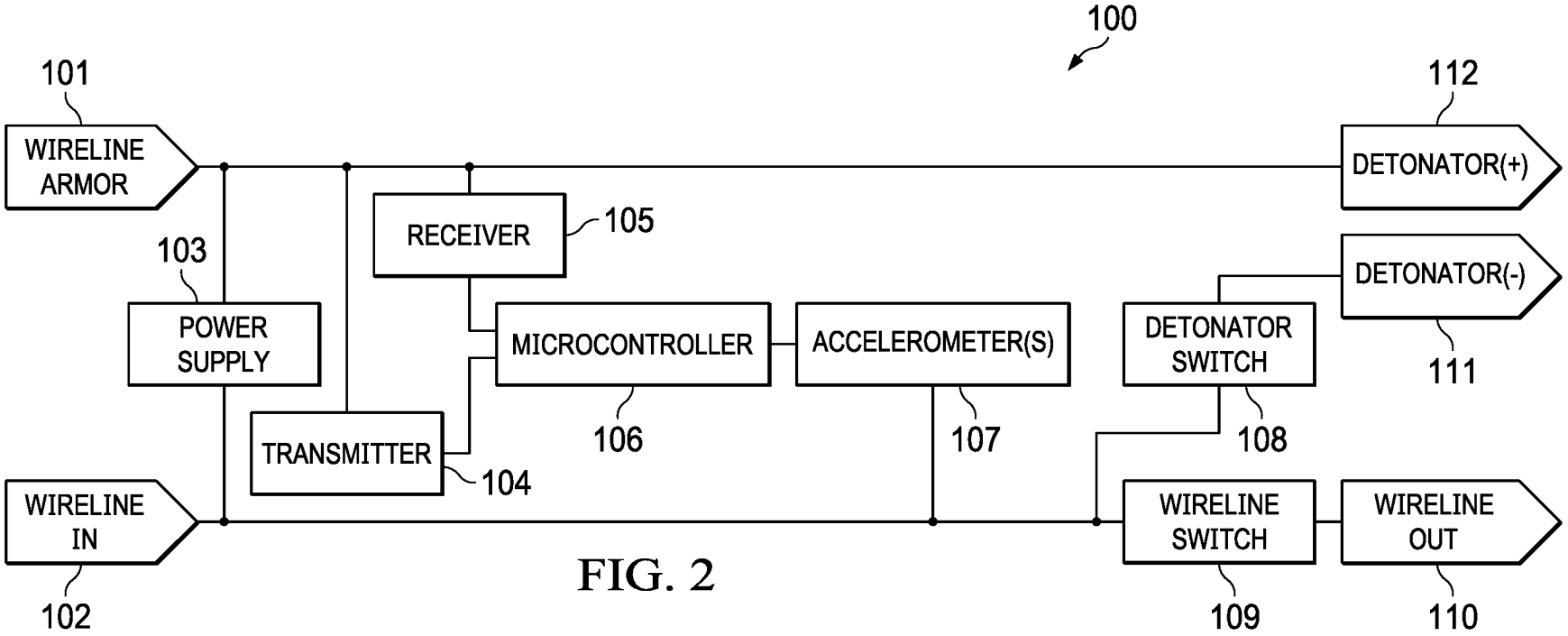
FIG. 2 shows an example embodiment of the orientation detection circuity incorporated into the perforating gun circuity.

An example embodiment of the perforating gun circuitry 100 is shown in FIG. 2. The wiring for the perforating gun 10 includes a wireline armor 101 and a wireline in 102, both connected to the power supply 103. The wireline armor 101 is connected to the positive terminal 112 of the detonator 23. There is a transmitter 104 and a receiver 105 that are both connected to microcontroller 106, which is further connected to the accelerometer(s) 107. A detonator switch 108 is coupled to the detonator negative terminal 111. Wireline switch 109 is disposed between the wireline in 102 and the wireline out 110. The accelerometer(s) 107 will get its power from the power supply 103 and the ground reference will be to wireline in.

Figure 3:
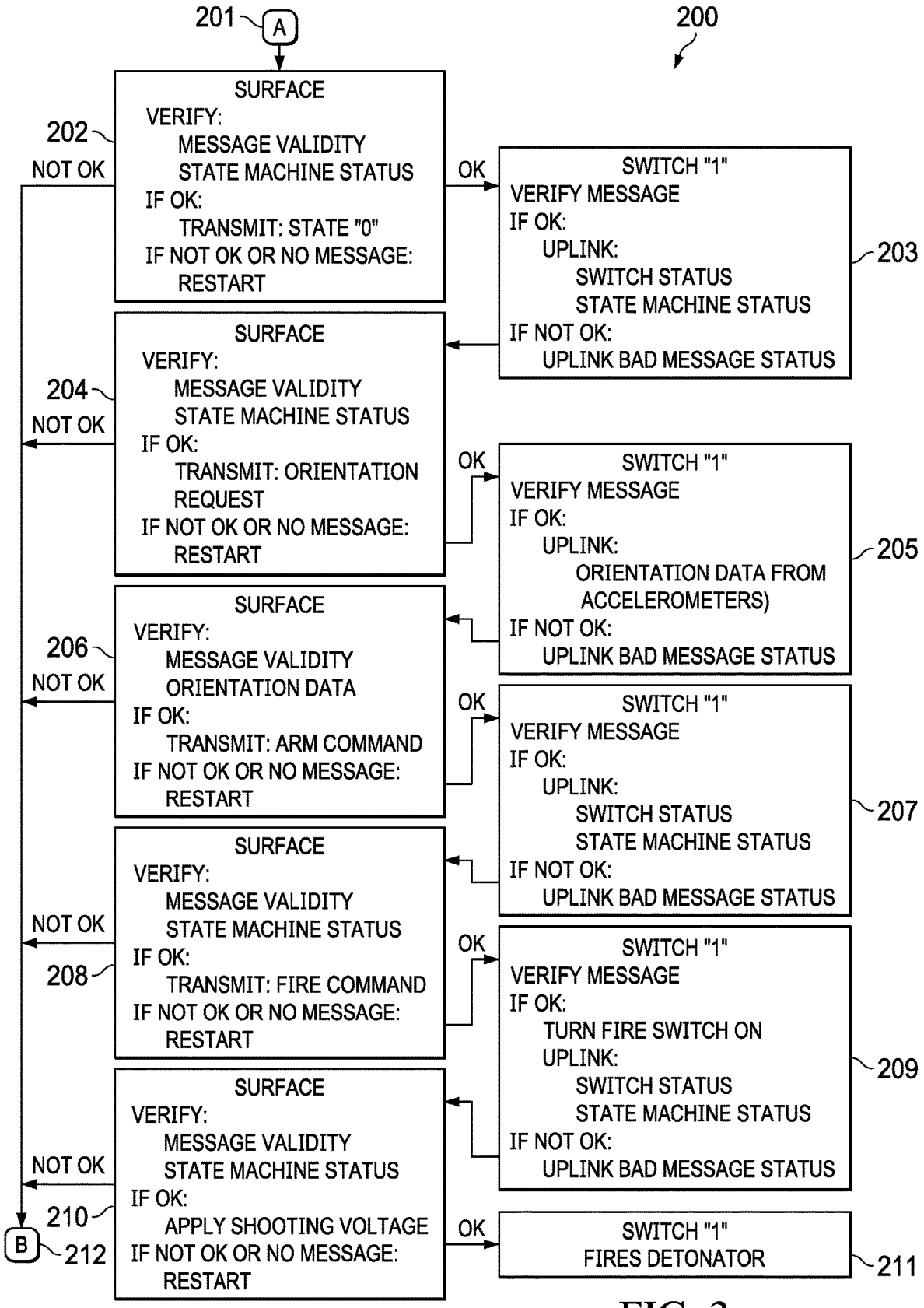
FIG. 3 shows an example embodiment of a programming sequence illustrating the function of the perforating gun.

An example embodiment of the software flow chart 200 is shown in FIG. 3. The process starts at 201. At the surface 202 the system verifies the machine status and transmits state "0". If OK then switch 203 sends the switch status and states the machine status, if NOT OK a bad message status is uplinked to the surface. At the surface 204, the system validates switch status and if OK it then transmits the orientation request to the switch. At the switch 205, the message is verified and then if OK the switch uplinks the orientation data from the accelerometer(s).

At the surface 206, the system validates orientation data and if OK it then transmits the arm command to the switch. At the switch 207, the message is verified and then if OK the switch uplinks the switch status.

At the surface 208, the system validates switch status and if OK it then transmits the fire command to the switch. At the switch 209, the message is verified and then if OK the switch activates the fire switch and then uplinks the switch status.

At the surface 210, the system validates switch status and if OK it then applies the shooting voltage to the switch. At the switch 211, the switch fires the detonator.

If the switch is NOT OK at 203, 205, 207, 209 then a bad message status is uplinked. If a NOT OK machine status is verified at 202, 204, 206, 208, or 210 then the system ends the program at 212.

Examples of applications where the orientation detection can be usefully applied include, but are not limited to, any well operation in which the orientation of two or more selective initiation devices need to be confirmed prior to each initiation. Examples other than perforating include: setting valves, initiating cutters to cut casing, initiating a severing tool or back off tool to free stuck pipe, delivering stimulation treatment to perforation zone(s), or initiating any other ballistic devices downhole in a specific orientation. An additional application may include the surface operator determining the deviation of a wellbore at any point in time by communicating with the perforating gun 10 located in the downhole perforating assembly.

The electronic selective firing switch with orientation detection capabilities or Orientation Detection Switch (ODS) 22 can be used to selectively initiate individual perforating guns in a multi gun perforating tool string. The ODS 22 may include an onboard 3-axis accelerometer sensor that can measure the rotated gravitational field vector to determine the accelerometer pitch and roll orientation angles, which data can be sent back to the surface control panel and processed as an orientation output for the operator. This gives the operator orientation information of each ODS 22 relative to zero degrees. The ODS 22 can be embedded in each perforating gun's 10 charge tube assembly 12 in a known fixed position so that the orientation in relation to zero degrees of the shaped charge loading tube 12 of each perforating gun 10 is the output for the user. The operator can then determine if the orientation of the perforating gun 10 is acceptable before initiating the perforating gun.

Another example embodiment may include a self-orienting perforating gun 10 that utilizes an embedded ODS 22 in the shaped charge loading tube assembly 12 which can rotate freely inside the perforating gun body 11. The position of the ODS 22 in relationship to the position of the perforating charges 16 can be designed such that the perforating charges 16 are pointing in a desired direction when the gun string is stationary and laying laterally in the horizontal well bore.

Also described is an oriented perforating gun run above and/or below eccentric weight bars that utilizes an embedded ODS 22 in the shaped charge tube assembly 12 or in a tandem sub between guns, which can rotate with the perforating gun 10 due to the influence of the eccentric weights. The position of the ODS 22 in relationship to the position of the perforating charges 16 can be designed such that the perforating charges 16 are pointing in a desired direction when the perforating gun 10 is stationary and laying laterally in the horizontal well bore.

The electronic switch 22 used in this operation has an onboard accelerometer with orienting detecting capabilities and is called an Orientation Detection Switch (ODS) 22.

The select fire multiple perforating gun tool string is deployed to the bottom depth of a horizontal cased hole well bore via wireline cable. When at the bottom, the user or operator at the surface sends digital command via the surface control panel and software to address the downhole orientation detection switches 22 which are located within each perforating gun assembly 10 in the multiple perforating gun tool string. Each ODS 22 receives the command and transmits a digital signal back to surface telling the user each ODS 22 is operational and ready to be addressed and armed.

When ready to initiate a perforating gun 10, the user will arm the ODS 22 of the perforating gun 10 to be initiated via a software command from surface. When the arm command is received by the ODS 22 of the perforating gun 10 to initiated, the ODS 22 will signal to surface its readiness to enable fire as well as the orientation data from its onboard accelerometer 107. The orientation data will be processed at surface by the control panel and software and output as an orientation angle relative to zero. The location of the ODS 22 within the perforating gun 10 is fixed by design in order to determine the direction which the shaped charges will fire based on the ODS 22 orientation data.

By analyzing the orientation data, the user can decide if the orientation of the perforating gun 10 to be fired is acceptable. If acceptable, the user can send the enable fire signal to the ODS 22 in the armed gun to be fired followed by applying power to initiate the detonator 23 attached to the addressed ODS 22.

An example embodiment may include an electronic switch 22 which may be used to selectively address and initiate a downhole ballistic device which has an onboard 3-axis accelerometer 107, which can independently provide orientation data for each perforating gun in which the switch is embedded. The electronic switch 22 may be used to selectively address and initiate a downhole ballistic device which has an onboard 2-axis accelerometer 107 and can independently provide orientation data for each perforating gun 10 in which the switch 22 is embedded when the perforating gun 10 is in the horizontal section of the wellbore. An example embodiment may include using a mechanical orienting tool above the gun string with the ability to rotate the downhole guns 10, an electronic switch 22 may then be used to selectively address and initiate a downhole ballistic device which has an onboard single-axis accelerometer 107 that can provide orientation data for each perforating gun 10 in which the switch 22 is embedded.

An example embodiment may include an electronic switch 22 used to selectively address and initiate a downhole ballistic device—such as a detonator 23 in a perforating gun 10—which has an onboard accelerometer sensor 107 that can detect the switch's 22 orientation in relation to zero degrees and send that orientation data to surface to be processed and presented to the user.

An example embodiment may include a perforating gun 10 comprising of a gun body 11, and charge tube 12 which holds shaped charges 16, a top end fitting 13 on one end of the charge tube 12. The other end of the charge tube 12 includes a feed thru puck 14 located adjacent to a baffle 15. The orientation detection switch 22 is contained within the gun body 11 of the perforating gun 10.

An example embodiment may include a perforating gun 10 comprising a gun body 11, and charge tube 12 which holds shaped charges 16. It may include end fittings on either end of the charge tube 12, where the orientation detection switch 22 is contained within either end fitting on the shaped charge loading tube within the perforating gun assembly.

An example embodiment may include perforating gun 10 comprising of a gun body 11, and charge tube 12 which holds shaped 16, and end fittings on either end of the charge tube 12, where the orientation detection switch 22 is contained affixed to the inner wall of the gun body 11 of the perforating gun 10.

An example embodiment may include a perforating gun 10 featuring a charge tube 12 containing the orientation detection switch 22, where the charge tube 12 is designed to rotate inside of the gun body 11 due to gravitational force when the perforating gun 10 is laying laterally in a horizontal position. The charge tube's 12 ability to rotate within the perforating gun 10 may or may not be assisted by ball bearings or other rotation assisting devices located between the outer diameter of the charge tube 12 and the inner diameter of the gun body 11. The charge tube's 12 ability to rotate within the perforating gun 10 may or may not be assisted by ball bearings or other rotation assisting devices located between the outer diameter of the charge tube 12 end fittings and the inner diameter of the gun body 11.

An example embodiment may include a perforating gun 10 comprising a gun body 11, and charge tube 12 which holds shaped charges 16, end fittings on either end of the charge tube 12 and a tandem sub which physically connects one perforating gun 10 to another, where the orientation detection switch 22 is contained within the tandem sub bore.

An example embodiment may include a perforating gun 10 comprising of a gun body 11, and charge tube 12 which holds shaped charges 16, end fittings on either end of the charge tube 12, a tandem sub which physically connects one perforating gun 10 to another and a contact cartridge inside the tandem sub to electrically connect one perforating gun 10 to another, where the orientation detection switch 22 is contained within the contact cartridge.

An example embodiment may include a method for detecting the orientation of each individual perforating gun 10 in a multiple select fire perforating gun string prior to initiating each gun. An example embodiment may include a method for detecting the deviation of the wellbore in which the perforating gun string is located at any point in time.

Although the example embodiments have been described in terms of embodiments which are set forth in detail, it should be understood that this is by illustration only and that the example embodiments are not necessarily limited thereto. For example, terms such as upper and lower or top and bottom can be substituted with uphole and downhole, respectfully. Top and bottom could be left and right, respectively. Uphole and downhole could be shown in figures as left and right, respectively, or top and bottom, respectively. Generally downhole tools initially enter the borehole in a vertical orientation, but since some boreholes end up horizontal, the orientation of the tool may change. In that case downhole, lower, or bottom is generally a component in the tool string that enters the borehole before a component referred to as uphole, upper, or top, relatively speaking. The first housing and second housing may be top housing and bottom housing, respectfully. In a gun string such as described herein, the first gun may be the uphole gun or the downhole gun, same for the second gun, and the uphole or downhole references can be swapped as they are merely used to describe the location relationship of the various components. Terms like wellbore, borehole, well, bore, oil well, and other alternatives may be used synonymously. Terms like tool string, tool, perforating gun string, gun string, or downhole tools, and other alternatives may be used synonymously. The alternative embodiments and operating techniques will become apparent to those of ordinary skill in the art in view of the present disclosure. Accordingly, modifications of the example embodiments are contemplated which may be made without departing from the spirit of the claimed example embodiments.

What is claimed is:

1. A perforating gun system comprising:

a perforating gun string having at least one perforating gun, the perforating gun further comprising:

a housing, a charge tube, a plurality of shaped charges, a detonator cord having a distal end and further coupled to the plurality of shaped charges, a detonator located proximate to the distal end of the detonator cord, an electronic switch having an onboard 3-axis accelerometer, wherein the switch is adapted to selectively address and initiate the shaped charges and activate and disarm a safety to disable detonator initiation based on orientation of the perforating gun detected by the accelerometer.

2. The perforating gun system of claim 1, wherein the switch provides orientation data for at least one shaped charge.

3. The perforating gun system of claim 1, wherein the switch independently provides orientation data for each shaped charge in a gun string.

4. The perforating gun system of claim 1, wherein the switch signals to the surface that the perforating gun casing is in the horizontal section of a wellbore.

5. The perforating gun system of claim 1, further comprising a mechanical orienting tool above the gun string with the ability to rotate at least one downhole gun.

6. The perforating gun system of claim 1, wherein the electronic switch activates the safety to prevent firing the detonator when a vertical orientation of the perforating gun is detected by the accelerometer.

7. The perforating gun system of claim 1, wherein the electronic switch disarms the safety to allow the firing of the detonator when a horizontal orientation of the perforating gun is detected by the accelerometer.

8. The perforating gun system of claim 1, wherein the shaped charges are in a single plane.

9. A perforating gun system comprising:

a perforating gun string having at least one perforating gun, the perforating gun further comprising:

a housing, a charge tube, a plurality of shaped charges, a detonator cord having a distal end and further coupled to the plurality of shaped charges, a detonator located proximate with the distal end of the detonator cord, an electronic switch having an onboard 2-axis accelerometer, wherein the switch is adapted to selectively address and initiate the shaped charges and activate and disarm a safety to disable detonator initiation based on orientation of the perforating gun detected by the accelerometer.

10. The perforating gun system of claim 9, wherein the switch provides orientation data for at least one shaped charge.

11. The perforating gun system of claim 9, wherein the switch independently provides orientation data for each shaped charge in a gun string.

12. The perforating gun system of claim 9, wherein the switch signals to the surface that the perforating gun casing is in the horizontal section of a wellbore.

13. The perforating gun system of claim 9, further comprising a mechanical orienting tool above the gun string with the ability to rotate at least one downhole gun.

14. The perforating gun system of claim 9, wherein the electronic switch activates the safety to prevent firing the detonator when a vertical orientation of the perforating gun is detected by the accelerometer.

15. The perforating gun system of claim 9, wherein the electronic switch disarms the safety to allow the firing of the detonator when a horizontal orientation of the perforating gun is detected by the accelerometer.

16. The perforating gun system of claim 9, wherein the shaped charges are in a single plane.

17. A perforating gun system comprising:

a perforating gun string having at least one perforating gun, the perforating gun further comprising:

a housing, a charge tube, a plurality of shaped charges, a detonator cord having a distal end and further coupled to the plurality of shaped charges, a detonator located proximate with the distal end of the detonator cord, an electronic switch having an onboard single-axis accelerometer, wherein the switch is adapted to selectively address and initiate the shaped charges and activate and disarm a safety to disable detonator initiation based on orientation of the perforating gun detected by the accelerometer.

18. The perforating gun system of claim 17, wherein the switch provides orientation data for at least one shaped charge.

19. The perforating gun system of claim 17, wherein the switch independently provides orientation data for each shaped charge in a gun string.

20. The perforating gun system of claim 17, wherein the switch signals to the surface that the perforating gun casing is in the horizontal section of a wellbore.

21. The perforating gun system of claim 17, further comprising a mechanical orienting tool above the gun string with the ability to rotate at least one downhole gun.

22. The perforating gun system of claim 17, wherein the electronic switch activates the safety to prevent firing the detonator when a vertical orientation of the perforating gun is detected by the accelerometer.

23. The perforating gun system of claim 17, wherein the electronic switch disarms the safety to allow the firing of the detonator when a horizontal orientation of the perforating gun is detected by the accelerometer.

24. The perforating gun system of claim 17, wherein the shaped charges are in a single plane.

* * * * *